US006234644B1

(12) United States Patent
Kotovsky et al.

(10) Patent No.: US 6,234,644 B1
(45) Date of Patent: May 22, 2001

(54) METHOD AND APPARATUS FOR A LIGHTING AND/OR MECHANICAL SYSTEM

(75) Inventors: Irwin Kotovsky, 3941 California Ave., Pittsburgh, PA (US) 15212; Serge Cornelissen; Robert Cornelissen, both of Roeselare (BE)

(73) Assignee: Irwin Kotovsky, Pittsburgh, PA (US)

( * ) Notice: Subject to any disclaimer, the term of this patent is extended or adjusted under 35 U.S.C. 154(b) by 0 days.

(21) Appl. No.: 09/049,561

(22) Filed: Mar. 27, 1998

(51) Int. Cl.[7] ..... F21S 8/00

(52) U.S. Cl. ..... 362/148; 362/147; 362/287; 362/365; 362/427

(58) Field of Search ..... 362/145, 147, 362/287, 427, 364, 365, 148, 372

(56) References Cited

U.S. PATENT DOCUMENTS

| | | | | |
|---|---|---|---|---|
| 4,518,896 | * | 5/1985 | Miles, Jr. | 315/162 |
| 4,551,791 | | 11/1985 | Salansky . | |
| 4,729,074 | * | 3/1988 | Steadman | 362/148 |
| 5,421,701 | * | 6/1995 | Funston | 415/5 |
| 5,823,664 | * | 10/1998 | Demshki, Jr. et al. | 362/366 |
| 5,857,766 | * | 1/1999 | Sieczkowski | 362/365 |

FOREIGN PATENT DOCUMENTS 0 732 535 9/1996 (EP) .

OTHER PUBLICATIONS

Article in "Lighting Architecture".

* cited by examiner

*Primary Examiner*—Sandra O'Shea
*Assistant Examiner*—John Anthony Ward
(74) *Attorney, Agent, or Firm*—Ansel M. Schwartz

(57) ABSTRACT

The present invention pertains to a system for holding equipment in a ceiling. The system comprises a first side member. The system comprises a second side member in spaced relation with the first side member. The first side and second side members define a length between them. The system comprises a connecting member which attaches to the first side and second side members and connects the first side member with the second side member. The length between the first side member and second side member is variable and defined by the length of the connecting member. The first side member and second side member and connecting member are distinct from each other. The present invention pertains to a method for forming a lighting system comprising the steps of attaching a top plate to a first main profile and a second main profile in parallel and spaced relation with the first main profile to define a trough. Each main profile has a bottom. Then there is the step of connecting a trim or trimless profile in proximity to the bottom end of each main profile. Next there is the step of installing a lighting fixture in the trough.

15 Claims, 9 Drawing Sheets

METHOD AND APPARATUS FOR A LIGHTING AND/OR MECHANICAL SYSTEM

FIELD OF THE INVENTION

The present invention is related to a system. More specifically, the present invention is related to a lighting system formed from individual parts of two main profiles, a top plate and trim or trimless profiles which fit together.

BACKGROUND OF THE INVENTION

The present invention provides all specifiers architects, designers, etc. and all users with a system for incorporating their lighting and other requirements in a flexible, inconspicuous, unobtrusive manner. Such a system does not exist. In the present invention, the sides of the profile are completely free of all openings and/or the intrusion of any hardware, although invisible hardware for whatever purpose, of course, can be utilized depending upon project requirements. The lamp source, wiring and other normal unattractive fixture hardware is not visible. In the past, when troughs were used hardware fastening devices, mechanical mechanisms and wiring were visible.

SUMMARY OF THE INVENTION

The present invention pertains to a system for holding equipment in a ceiling. The system comprises a first side member. The system comprises a second side member in spaced relation with the first side member. The first side and second side members define a length between them. The system comprises a connecting member which attaches to the first side and second side members and connects the first side member with the second side member. The length between the first side member and second side member is variable and defined by the length of the connecting member. The first side member and second side member and connecting member are distinct from each other.

The present invention pertains to a method for forming a lighting system comprising the steps of attaching a top plate to a first main profile and a second main profile in parallel and spaced relation with the first main profile to define a trough. Each main profile has a bottom. Then there is the step of connecting a trim or trimless profile in proximity to the bottom end of each main profile. Next there is the step of installing a lighting fixture in the trough.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
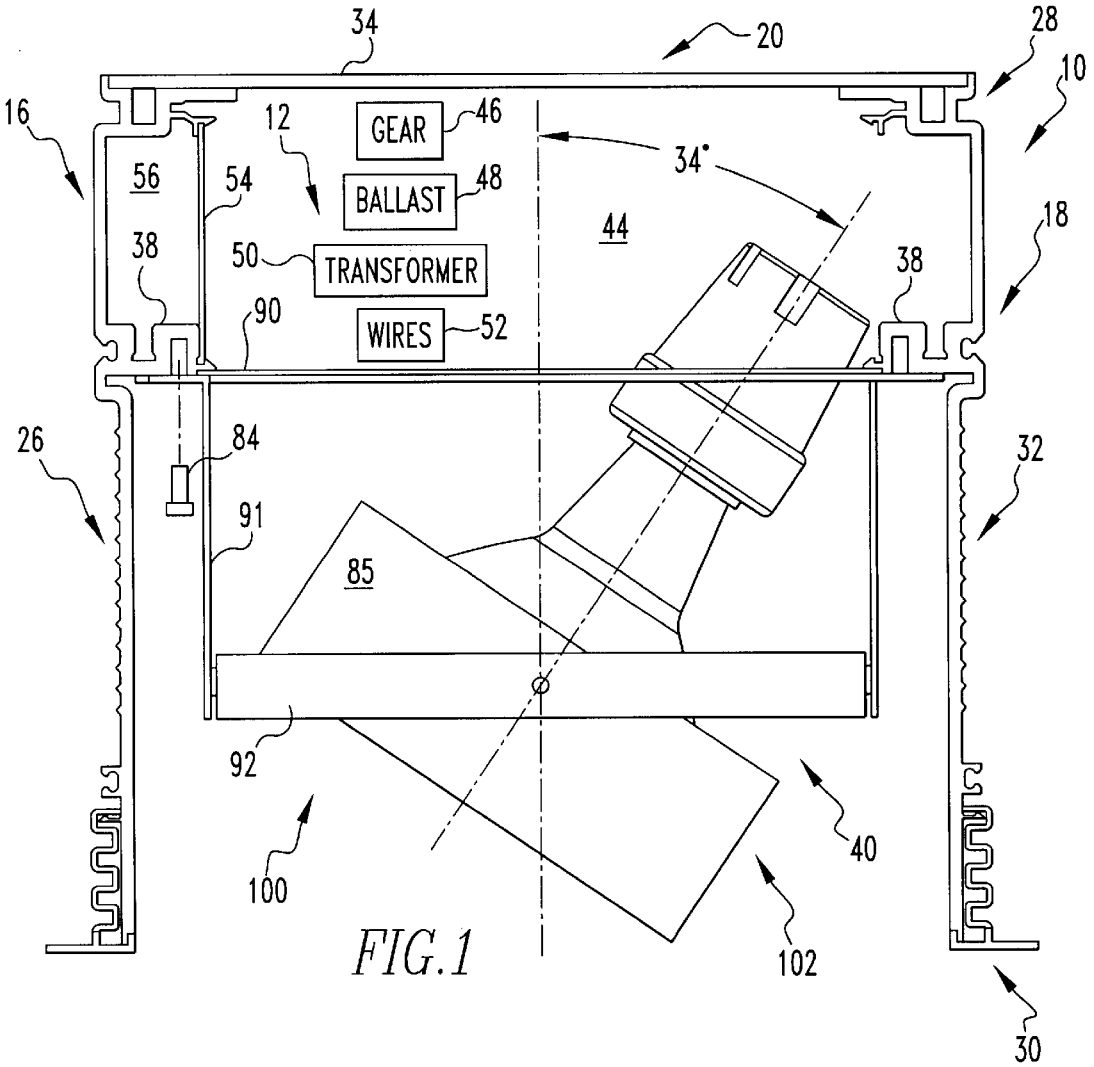
FIG. 1 is a schematic representation of a side view of a system of the present invention.
Figure 2:
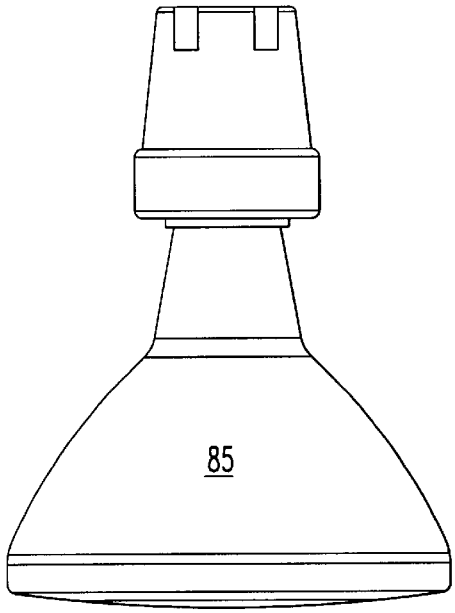
FIG. 2 is a schematic representation of a light.
Figure 3:
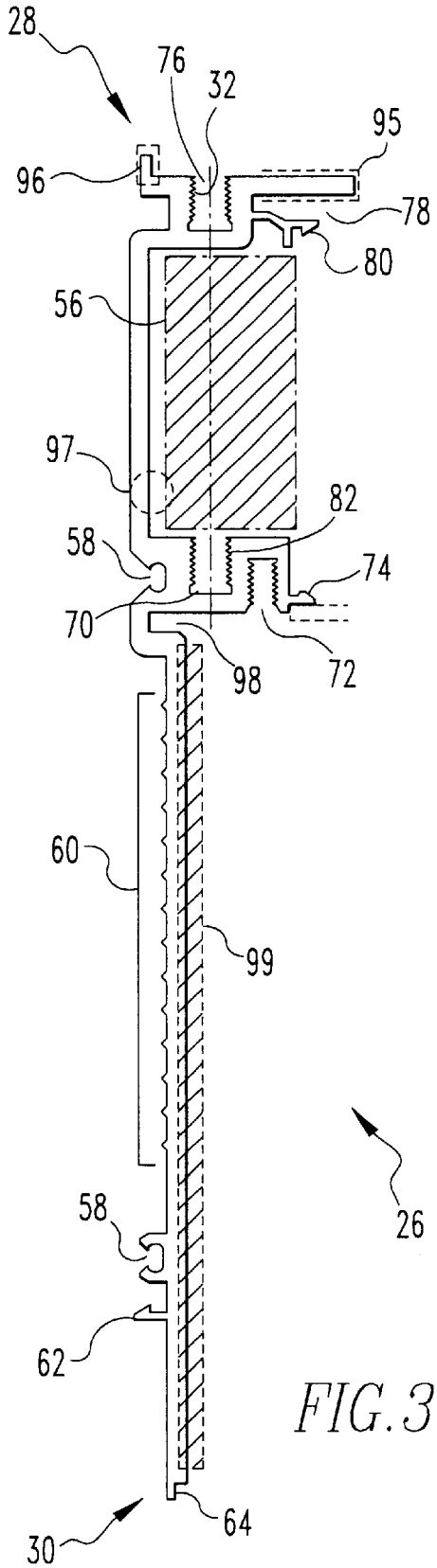
FIG. 3 is a schematic representation of a main profile.
Figure 4:
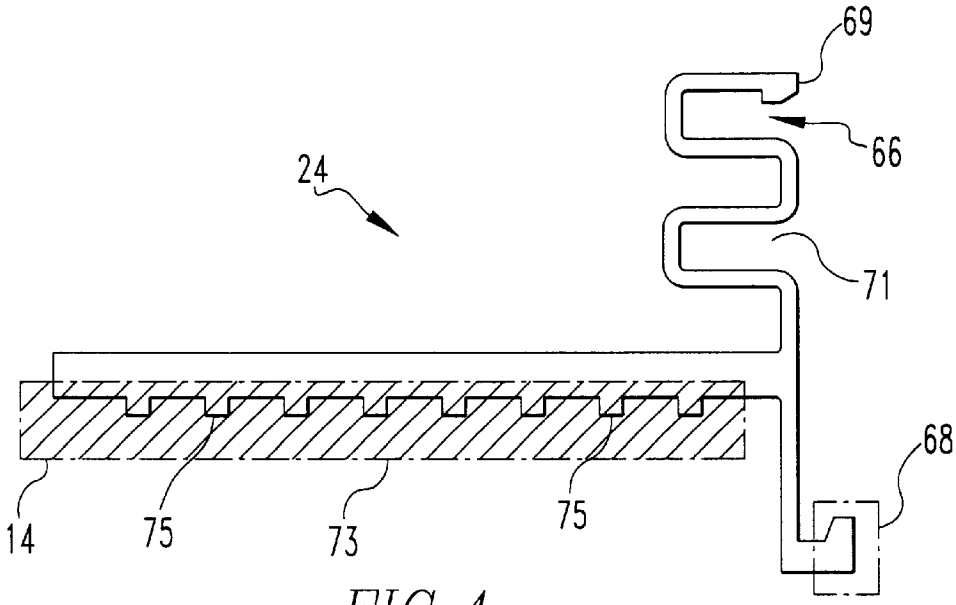
FIG. 4 is a schematic representation of a trimless profile.
Figure 5:
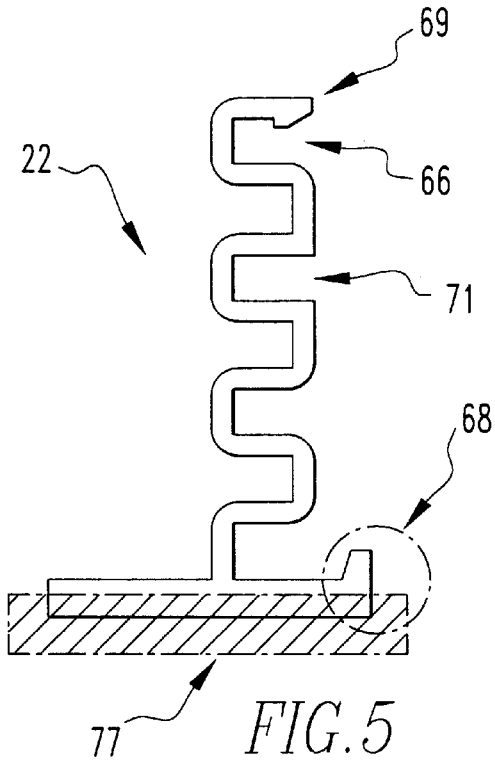
FIG. 5 is a schematic representation of a trim profile.
Figure 6:
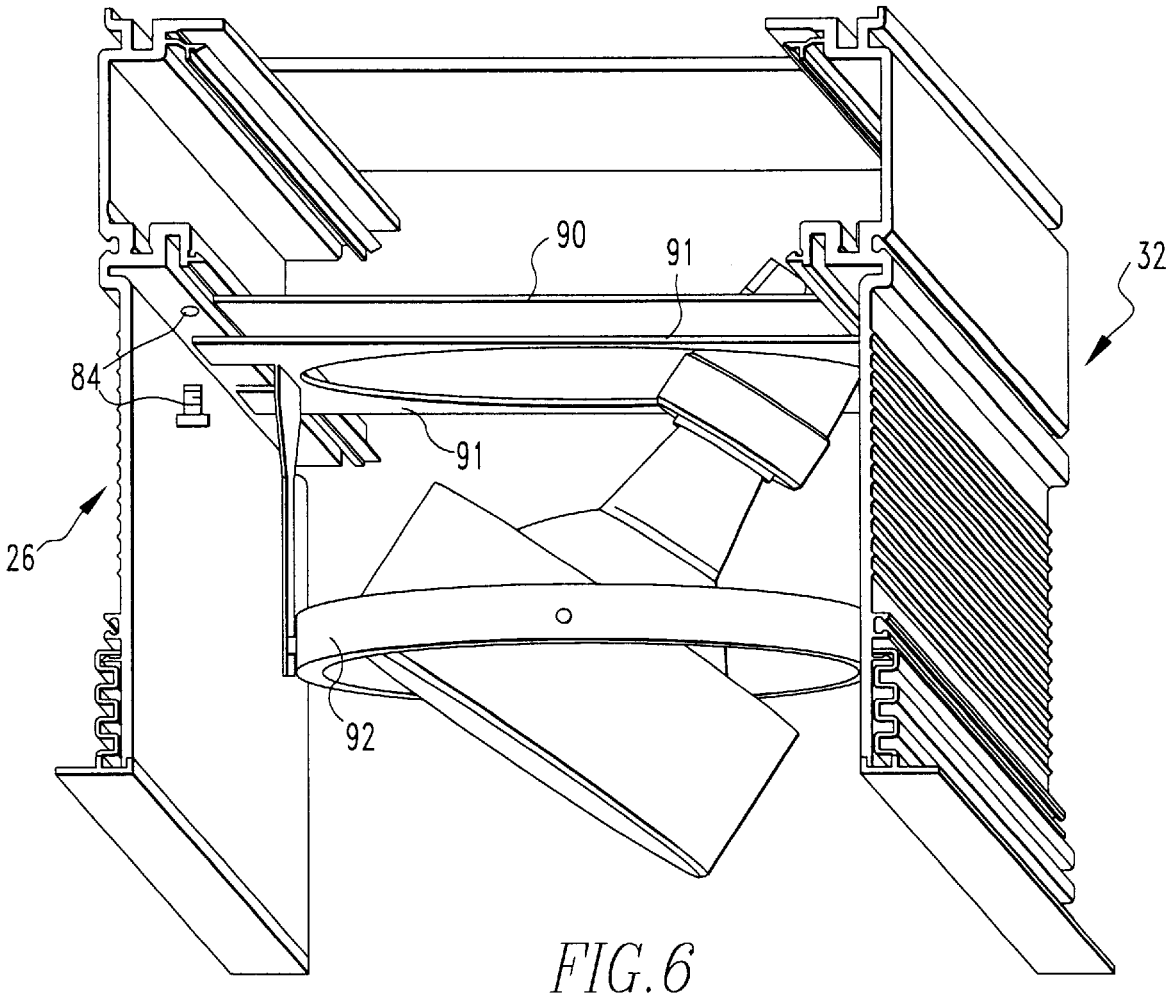
FIG. 6 is an isometric view of the system.
Figure 7:
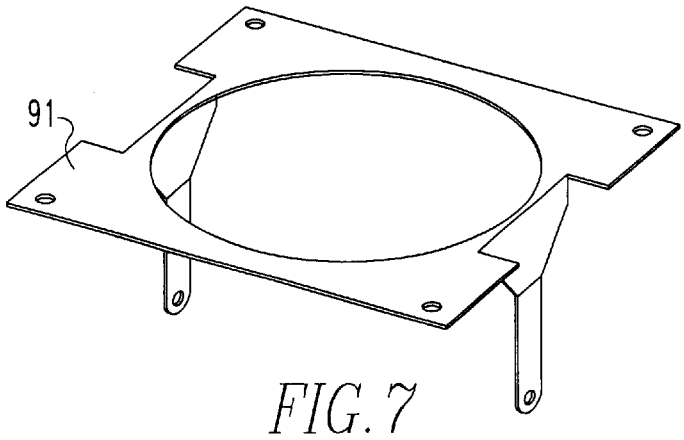
FIG. 7 is a schematic representation of a bracket.

Referring now to the drawings wherein like reference numerals refer to similar or identical parts throughout the several views, and more specifically to FIGS. 1–7 thereof, there is shown a system 10 for holding equipment 12 in a ceiling 14. The system 10 comprises a first side member 16. The system 10 comprises a second side member 18 in spaced relation with the first side member 16. The first side and second side members define a length between them. The system 10 comprises a connecting member 20 which attaches to the first side and second side members and connects the first side member 16 with the second side member 18. The length between the first side member 16 and second side member 18 is variable and defined by the length of the connecting member 20. The first side member 16 and second side member 18 and connecting member 20 are distinct from each other.

Preferably, the second side member 18 is in parallel with the first side member 16, and the connecting member 20 is perpendicular with the first and second side members. Preferably, the first side member 16 includes a first main profile 26 having a top 28 and a bottom 30 and the second side member 18 includes a second main profile 32 having a top 28 and a bottom 30. The connecting member 20 preferably includes a top plate 34 which attaches to the top 28 of the first and second main profiles.

Figure 10:
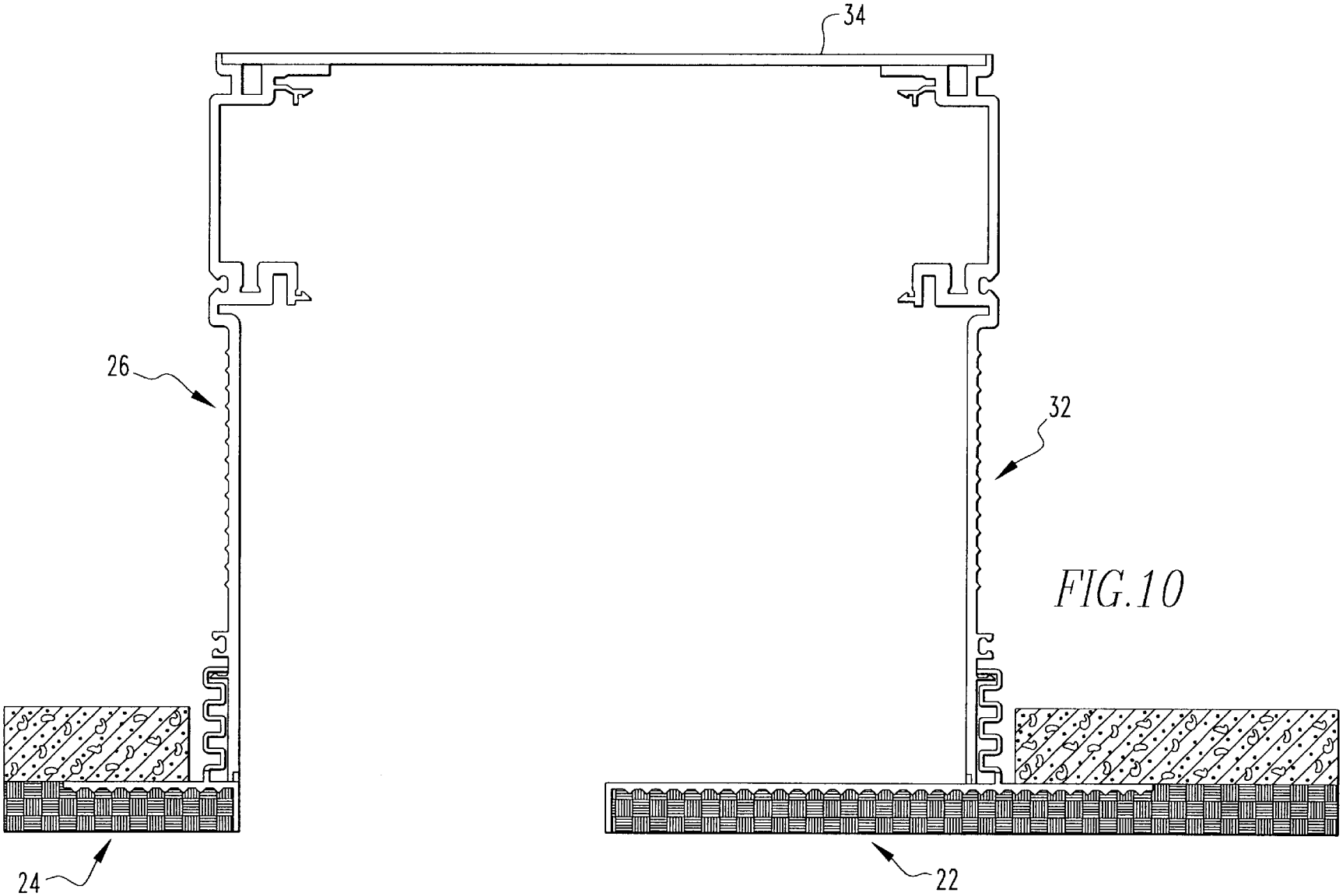
FIG. 10 is a schematic representation of an asymmetric trough.
Figure 11:
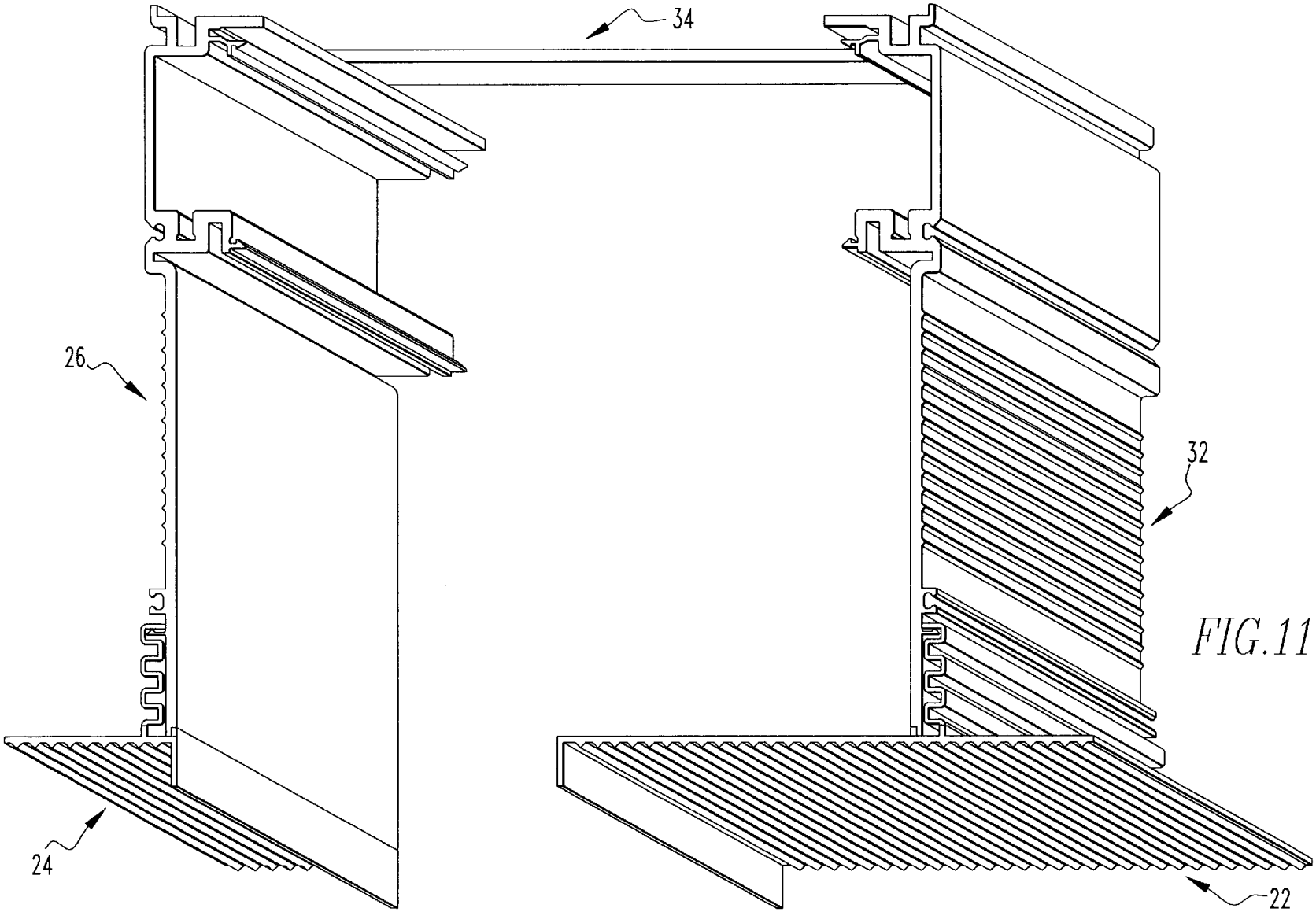
FIG. 11 is a schematic representation of an isometric view of the asymmetric trough.

The system 10 preferably includes a trim profile 22 and a trimless profile 24. Each side member attaches to either a trim profile 22 or a trimless profile 24 to form a symmetrical or asymmetrical cross-section, as shown in FIGS. 10 and 11. Preferably, the trim profile 22 or the trimless profile 24 is attached to the bottom 30 of the first or second main profiles.

Each main profile preferably includes an upper internally ribbed boss 36 in proximity to the top 28 of the main profile and a lower internally ribbed boss 38 in spaced relation with the upper internally ribbed boss 36. Preferably, the lower internally ribbed boss 38 is in parallel with the upper internally ribbed boss 36 and the top plate 34. The lower internally ribbed boss 38 on each main profile preferably are together adapted to hold a lamp 40 and define a horizontal cable run 44 between the top plate 34 and the lower internally ribbed boss 38 on the first and second main profile in which gear 46, ballast 48, transformers 50 or wires 52 can be disposed. Preferably, the lower and upper internally ribbed boss on each main profile together are adapted to hold a vertical plate 54 to define a vertical cable run 56.

Figure 9:
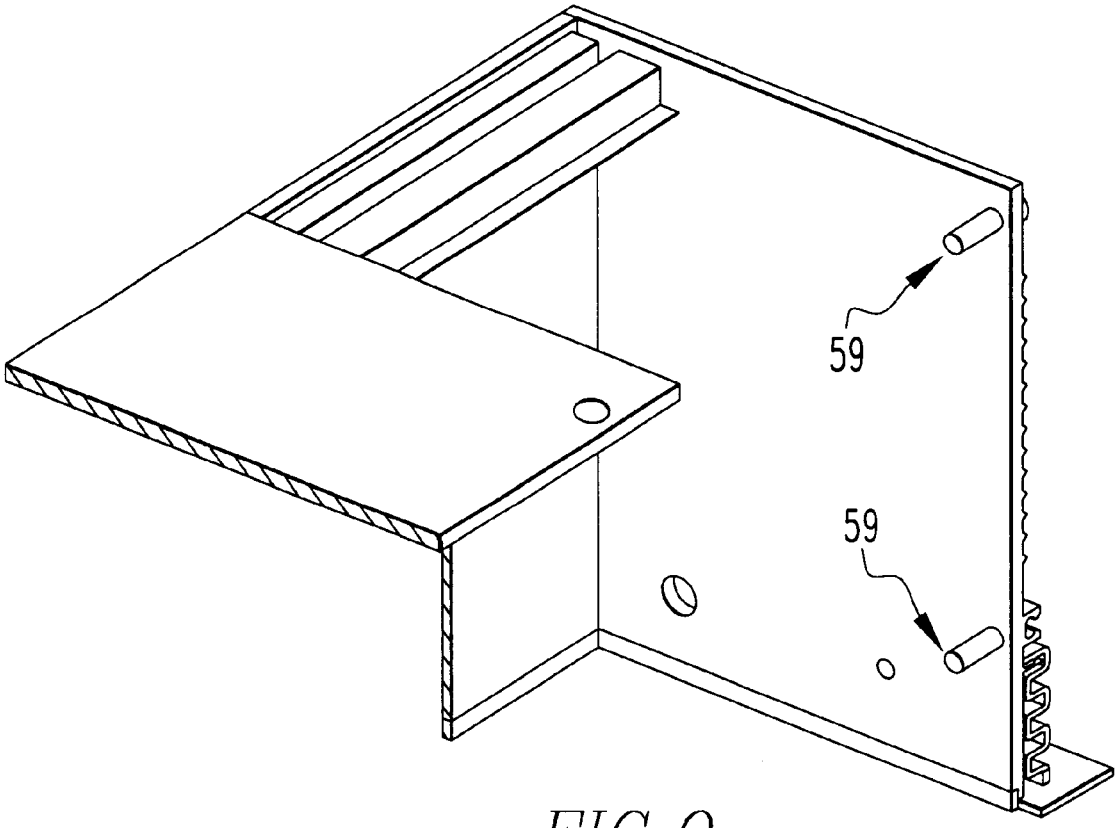
FIG. 9 is a schematic representation of a terminal plate with bolts.

Each main profile preferably includes external bosses 58 which are adapted to receive bolts 59 for supporting the first and second main profiles, as shown in FIG. 9. The external bosses 58 are preferably screw channels for ST 3.9 tapping screws; for fixation of terminating plates. Preferably, each main profile has horizontal ribs 60 to identify distance from the bottom 30 of each main profile. Preferably, the horizontal ribs 60 are part of the ceiling fixation concept; the ribs 60 can also serve as reference lines when holes must be drilled in this side of the main profile (for fixation of gimbal rings at different levels). The opposing inner surface 99 is able to remain clean and unmarked due to the overall design of the system. This provides for a more aesthetically pleasing trough. Each main profile preferably has a retaining rib 62 and a lower lip 64, and each trimless or trim profile has a slot 66 and a stem 68 which snap together with the retaining rib 62 and the lower lip 64, respectively, to hold the trimless or trim profile to the main profile. The retaining hub 62 is preferably a clipping feature that allows the profiles to be clipped irreversibly upon the main profile. The lower lip 64 preferably includes a space for the lower lip 64 of all trim or trimless profiles. The stem 68 preferably is an edge tab that hooks upon the main profile. The slot 66 preferably has a clipping feature 69 for irreversible clipping upon the main profile. There is preferably an M3 screw channel 71 for fixation of profile upon terminating plates. A zig-zagged morphology is used to increase the elastic play of the gripping feature. The trimless profiles can each have a platform 73 with dove-tail shaped ribs 75 for improved fastening of plasterwork. The trim profile 22 can have a visible surface 77 instead of the platform 73.

Figure 8:
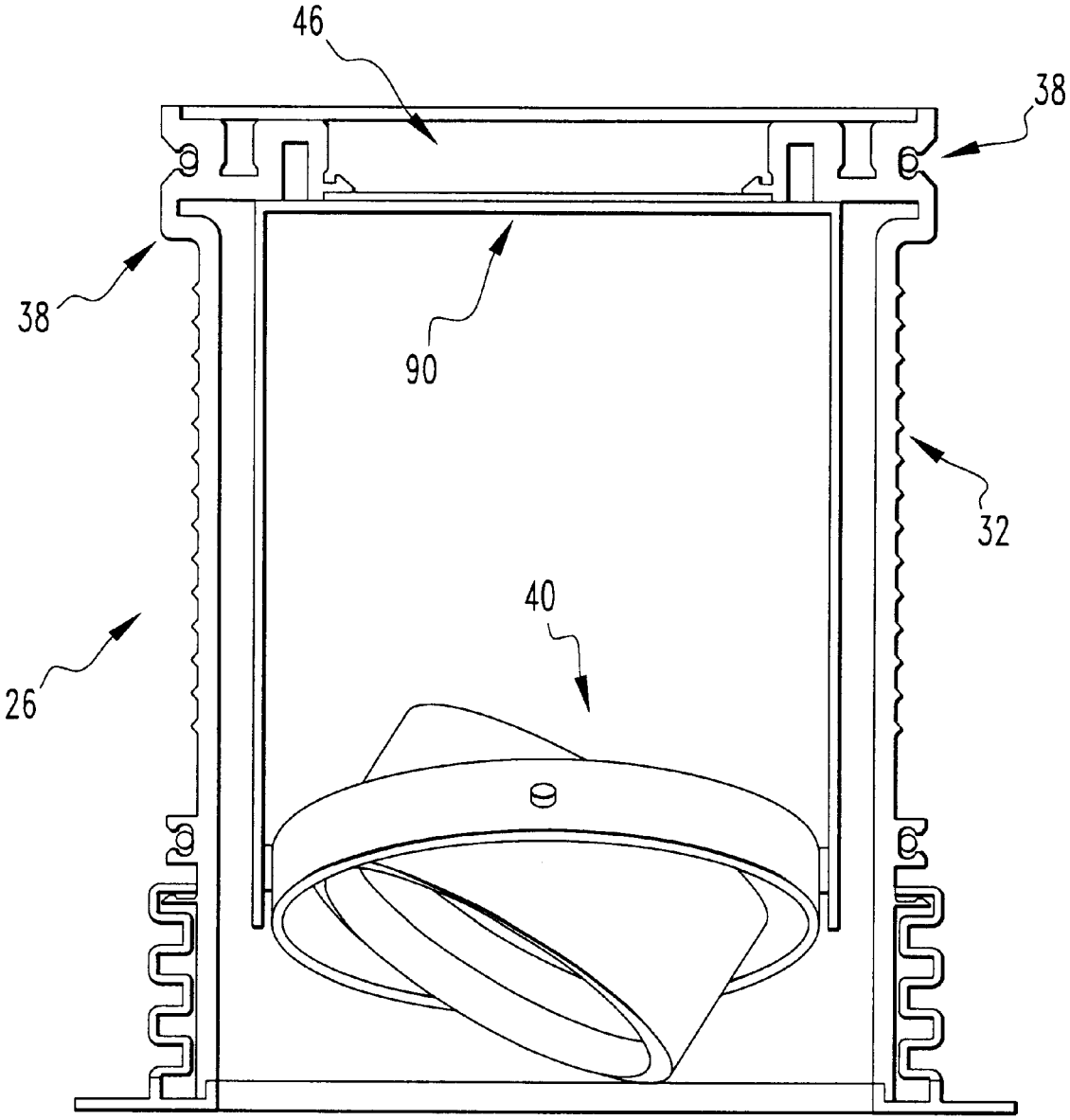
FIG. 8 is a schematic representation of a system having the main profiles reduced in size.

Preferably, each lower internally ribbed boss 38 has a first slot 70, a second slot 72 adjacent the first slot 70 and a lip 74 adjacent the second slot 72. Under the lip 74 there can be a space for inner cover plates 90 with thicknesses up to 1.2 mm. There can be a space 98 for platework parts with different functions: easy-slide-in lateral access by chamfered edge. The first slot 70 of the lower internally ribbed boss 38 is preferably used when the top half of the main profile is cut off, and is used for fixation of the "bridges" since it is grooved. See FIG. 8. Note also that the center lines of both the first slot 70 and the first slot 76 are collinear. The second slot is preferably an M6 screw channel for fixation of inner cover plates, brackets, yokes, a.s.o. with easy-entry chamfered edges. Each upper internally ribbed boss 36 preferably has a first slot 76, an upper inner horizontal slot 78 adjacent the first slot 76 and a lip 80 adjacent the upper inner horizontal slot 78. The upper inner horizontal slot 78 preferably is for mounting plates (transformers, terminals or any component). The first slot 76 and first slot 70 are preferably M6 screw channels for fixation of the "bridges" that connect two main profiles to each other. Preferably, each slot has grooves 82 in which screws can thread. The lips of the lower and upper internally ribbed boss are preferably tabs with a clipping-feature for a vertical plate 54 that closes the wiring compartment. There is preferably a reference line 97 for a circular sawing-machine; the top half of the main profile can be cut off when the built-in height is limited and the lower internally ribbed bosses attach to the top plate 34. Also, there is preferably a tab 96 for easy and quick positioning of "bridges", and a second tab 95 that helps keep "bridges" perpendicular to the main profile. In addition, the first slot 76, the tap 96 and the second tap 95 can be used to increase the height of the trough.

Preferably, the system 10 includes an inner cover plate 90 that fits against the lip 74 of each lower internally ribbed boss, a lamp bracket 91 which is held against the inner cover plate 90 with screws 84 that penetrate the lamp bracket 91 into the second slot 72 of the lower internally ribbed boss 38, a yoke 92 which attaches to the lamp bracket 91 and a light 85 which attaches to the yoke 92.

The basis of this linear system 10 is the use of extruded aluminum members which can easily be connected to one another. This is accomplished by placing the trimless profile 24 at 90 degrees to the main profile, interlocking the edges of the profiles then rotating the trimless profile 90 degrees until it snaps and locks into position on the main profile. Once locked into position, it cannot be unsnapped. The connection between the trim profile 24 and main profile is accomplished in the same manner. The use of individual extruded aluminum members provides one with the ability and flexibility of creating whatever width and height of trough 100 that is desired.

The use of extrusions also allows for straight alignment, precise mitered butt joints and intersections. In addition, three trim details, trimless or overlapping trim are provided.

The system provides space for integral gear, ballasts, and also transformers. In addition two separate integral vertical race ways to the left and right of the main profile compartment space are available for wiring. It is therefore possible to separate low voltage wiring from line voltage wiring or to have low voltage wiring and line voltage wiring in one race way and wiring for other purposes in the other raceway.

Within the troughs, there are several methods of securing the various models of lamps. One of the most predominate methods of securing lamps is by the use of rings 102.

The lamp rings can be attached to the sides of the profile with screws that go through holes in the main profile and thread into holes in the rings.

The lamp rings can be attached to yokes which are mounted with screws to an interior cover plate attached at 98 or 72 that conceals the (gear, ballast, transformer, etc.). For remote gear applications the yoke is mounted to the top cover plate. The sides of the yoke have holes which receive screws that thread into the outer ring.

The rings can be attached to brackets 91 which fit into the slotted openings 98 on either side of the extruded aluminum profile. Either a single bracket 91 or pair of brackets 91 can be utilized. The brackets 91 can slide in the slots 98 and the rings can be positioned where desired.

The rings can be attached to a plate 90 which has a circular opening to permit long lamps to pass through. The plate 90 contains two arms or brackets for attaching the rings with screws. The plate 90 itself can be attached to slotted openings 98 that are on either side of extruded aluminum trough. The plate 90 can slide in these slots 98 for positioning where desired. The plate can also be attached to second slot 72.

The rings can be attached to a u-shaped interior trough with screws that go through holes in the sides of the u-shaped trough and thread into holes in the rings. This u-shaped trough is held in place in slots 98.

The outer ring can be attached to the side of the extruded aluminum profile, to the brackets and/or the yokes and can be adjustable and lockable in a similar manner to the adjusting and locking between the inner and outer rings.

The normal relationship of width of ceiling opening is such that at 45 degrees the entire beam of light is unobstructed.

Figure 14:
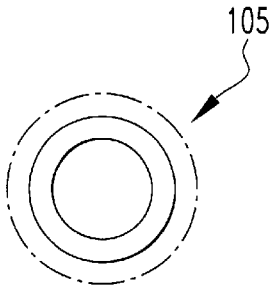
FIG. 14 is a schematic representation of an axial view of a spacer.
Figure 15:
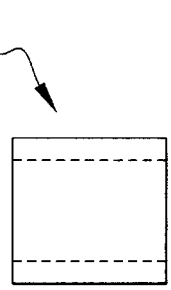
FIG. 15 is a schematic representation of a side view of a spacer.

As shown in FIGS. 14 and 15, a spacer 105 can be used between the outside ring and the main profile, bracket, or yoke to complete the fit between these parts.

Figure 12:
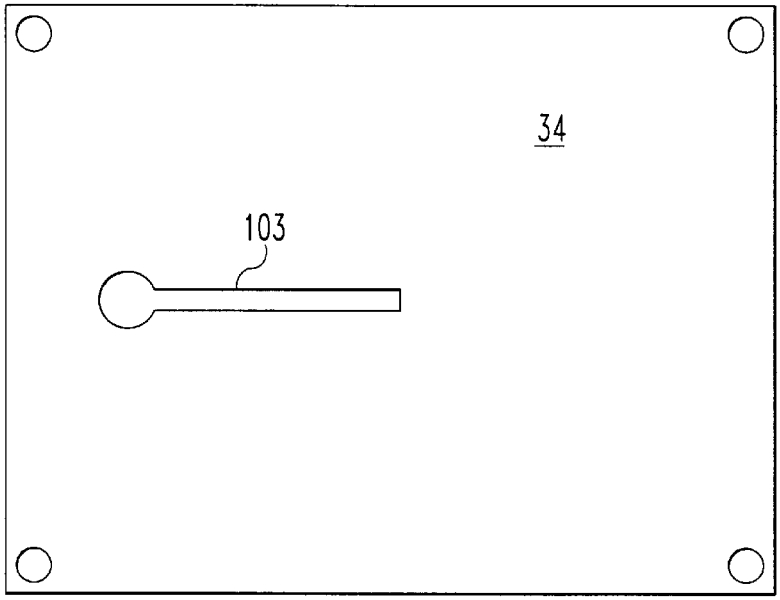
FIG. 12 is a schematic representation of an overhead view of a top plate.
Figure 13:
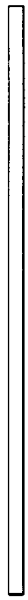
FIG. 13 is a schematic representation of a side view of a top plate.

Referring to FIGS. 12 and 13, the trough is installed by rods on bolts in the ceiling. The number of rods used is determined by the length and weight of the trough. A threaded rod or bolt is attached to the main structural members (concrete, I-Beams, black iron, etc.). Attached to the bottom of the rod is a nut and washer. The nut and washers are small enough to pass through the circular opening of the key hole slot 103 and slide along the key hole slot 103 but large enough to retain the top plate and entire structure when in the slotted portion of the key hole. The rods can be placed on whatever centers are required to meet the on-site conditions.

The present invention pertains to a method for forming a lighting system 10 comprising the steps of attaching a top plate 34 to a first main profile 26 and a second main profile 32 in parallel and spaced relation with the first main profile 26 to define a trough 102. Each main profile has a bottom 30. Then there is the step of connecting a trim or trimless profile in proximity to the bottom 30 of each main profile. Next there is the step of installing a lamp 40 in the trough 102.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A system for holding equipment in a wall or a ceiling comprising:

a first side member, the first side member includes a first main profile having a top and a bottom that extends perpendicularly from the wall or ceiling;

a second side member in spaced relation with the first side member, the second side member includes a second main profile having a top and a bottom that extends perpendicularly from the wall or ceiling, said first side and second side members defining a length between them; and a connecting member which attaches to the first side and second side members and connects the first side member with the second side member, the connecting member includes a top plate which attaches to the top of the first and second main profiles, each main profile includes an upper internally ribbed boss in proximity to the top of the main profile and a lower internally ribbed boss in spaced relation with the upper internally ribbed boss, the lower internally ribbed boss on each main profile are together adapted to hold a lamp and define a horizontal cable run between the top plate and the lower internally ribbed boss on the first and second main profile in which gear, ballast, transformers or wires can be disposed, said first side member and second side member and connecting member being distinct from each other.

2. A system as described in claim 1 wherein the second side member is in parallel with the first side member, and the connecting member is perpendicular with the first and second side members.

3. A system as described in claim 2 including a trim profile and a trimless profile, each side member attaching to either a trim profile or a trimless profile to form a symmetrical or asymmetrical cross-section.

4. A system as described in claim 3 wherein the trim profile or the trimless profile are attached to the bottom of the first or second main profiles.

5. A system as described in claim 4 wherein the lower internally ribbed boss is in parallel with the upper internally ribbed boss and the top plate.

6. A system as described in claim 5 wherein the lower and upper internally ribbed boss on each main profile together are adapted to hold a vertical plate to define a vertical cable run.

7. A system as described in claim 6 wherein each main profile includes external bosses which are adapted to receive bolts for supporting the first and second main profiles.

8. A system as described in claim 7 wherein each main profile has horizontal ribs to identify distance from the bottom of each main profile.

9. A system as described in claim 8 wherein each main profile has a retaining rib and a lower lip, and each trimless or trim profile has a slot and a stem which snap together with the retaining rib and the lower lip, respectively, to hold the trimless or trim profile to the main profile.

10. A system as described in claim 9 wherein each lower internally ribbed boss has a first slot, a second slot adjacent the first slot and a lip adjacent the second slot.

11. A system as described in claim 10 wherein each upper internally ribbed boss has a first slot, an upper inner horizontal slot adjacent the first slot and a lip adjacent the upper inner horizontal slot.

12. A system as described in claim 11 wherein each slot has grooves in which screws can thread.

13. A system as described in claim 12 including an inner cover plate that fits against the lip of each lower inner horizontal slot, a lamp bracket which is held against the inner cover plate with screws that penetrate the lamp bracket into the second slot of the lower inner horizontal slot, a yoke which attaches to the lamp bracket and a light which attaches to the yoke.

14. A system as described in claim 12 wherein the length between the first side member and second side member is variable and defined by the length of the connecting member.

15. A method for forming a lighting system comprising the steps of:

identifying a hole of a wall or ceiling for the lighting system to be placed in;

choosing a top plate of a desired length based on the hole size;

attaching the top plate to a first main profile and a second main profile in parallel and spaced relation with the first main profile to define a trough, each main profile having a bottom;

placing a lamp between a lower internally ribbed boss of the first and second main profiles which together hold the lamp and defines a horizontal cable run between the top plate and the internally ribbed bosses;

connecting a trim or trimless profile in proximity to the bottom end of each main profile.

* * * * *